US007626481B2

(12) United States Patent
Akimoto

(10) Patent No.: US 7,626,481 B2
(45) Date of Patent: Dec. 1, 2009

(54) IGNITION COIL

(75) Inventor: Katsunori Akimoto, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/183,240

(22) Filed: Jul. 31, 2008

(65) Prior Publication Data

US 2009/0033452 A1 Feb. 5, 2009

(30) Foreign Application Priority Data

Aug. 1, 2007 (JP) ..... 2007-200849

(51) Int. Cl.
*H01F 27/28* (2006.01)

(52) U.S. Cl. ..... 336/225

(58) Field of Classification Search ..... 336/65, 336/90–96, 107, 180–184, 198, 220–222, 336/225, 231

See application file for complete search history.

(56) References Cited

U.S. PATENT DOCUMENTS 4,739,947 A * 4/1988 Anseel et al. ..... 242/176
5,861,791 A * 1/1999 Schneider ..... 336/205
6,252,483 B1 * 6/2001 Kawano et al. ..... 336/189
7,079,000 B2 * 7/2006 Hamer et al. ..... 336/208
7,382,220 B2 * 6/2008 Keller ..... 336/90

FOREIGN PATENT DOCUMENTS

JP 2002-033230 1/2002

* cited by examiner

*Primary Examiner*—Tuyen Nguyen
(74) *Attorney, Agent, or Firm*—Nixon & Vanderhye, PC

(57) ABSTRACT

An ignition coil includes a coil body transversely arranged outside of a plug hole, and a plug connection portion protruding in a direction perpendicular to an axial direction of the coil body. A secondary coil of the coil body has a maximum outer diameter portion, and an inclined outer diameter portion arranged on two sides of the maximum outer diameter portion in the axial direction. The secondary coil includes a secondary electric wire that is wound obliquely around an outer periphery of a secondary spool such that reduced winding parts and enlarged winding parts are alternately superimposed on each other. The reduced winding part is wound with a winding diameter decreasing obliquely from one side to the other side in the axial direction, and the enlarged winding part is wound with a winding diameter increasing obliquely from the other side to the one side in the axial direction.

8 Claims, 7 Drawing Sheets

IGNITION COIL

CROSS REFERENCE TO RELATED APPLICATION

This application is based on Japanese Patent Application No. 2007-200849 filed on Aug. 1, 2007, the contents of which are incorporated herein by reference in its entirety.

FIELD OF THE INVENTION

The present invention relates to an ignition coil that can be used for generating sparks between a pair of electrodes in a spark plug for an internal combustion engine, for example.

BACKGROUND OF THE INVENTION

Ignition coils used in internal combustion engines are classified roughly into two types: a type in which a primary coil and a secondary coil accommodated in a resin coil case are arranged outside a plug hole of the engine, and a type in which a primary coil and a secondary coil accommodated in a resin coil case are arranged and inserted into a plug hole of the engine. In some ignition coils of the former type, the primary and secondary coils accommodated in the resin coil case are transversely arranged outside the plug hole such that the axial direction of the primary and secondary coils is aligned perpendicularly to the axial direction of the plug hole.

For example, JP-A-2002-33230 discloses an ignition coil of the type in which the primary and secondary coils are transversely arranged outside the plug hole. In this ignition coil, a plurality of flanges are formed in the outer periphery of a secondary spool (bobbin) to form a plurality of slots divided, on which the secondary coil is wound. Further, the secondary coil is formed so as to have a large winding diameter at the slot positioned in the center of the secondary spool in the axial direction and to have the winding diameter decreasing toward the two ends in the axial direction.

The ignition coil disclosed in the JP-A-2002-33230, however, does not sufficiently achieve reduction in size of a coil body accommodating the primary and secondary coils in the resin coil case. More specifically, because the flanges exist at the outer periphery of the secondary spool, the ignition coil disclosed in the JP-A-2002-33230 cannot sufficiently reduce the dimensions in the axial and radial directions.

SUMMARY OF THE INVENTION

The invention has been made in view of the foregoing problems, and it is an object of the invention to provide an ignition coil that can reduce the size of a coil body transversely arranged outside a plug hole.

According to an aspect of the present invention, an ignition coil includes: a coil body having a center core made of a soft magnetic material, a primary coil and a secondary coil, which are located in a coil case; and a plug connection portion protruding in a direction perpendicular to an axial direction of the coil body and adapted to bring a high-voltage side winding end of the secondary coil into conduction with a spark plug. The coil body can be transversely arranged outside a plug hole of an engine, and the plug connection portion can be inserted into and arranged in the plug hole. The primary coil is arranged on an inner peripheral side of the secondary coil, and the center core is arranged on an inner peripheral side of the primary coil, in the coil body. Furthermore, the plug connection portion is provided to protrude substantially from an intermediate position in the axial direction of the coil body.

In the ignition coil, the secondary coil has a maximum outer diameter portion with a maximum winding diameter arranged in the intermediate position in the axial direction, and an inclined outer diameter portion arranged on two sides of the maximum outer diameter portion in the axial direction, and the inclined outer diameter portion has a winding diameter decreasing toward two ends in the axial direction of the coil body. The secondary coil includes a secondary electric wire with an insulating film, wound around an outer periphery of a secondary spool, and is provided in an obliquely wound state where reduced winding parts and enlarged winding parts are alternately superimposed on each other. In addition, the reduced winding part including the secondary electric wire is wound with a winding diameter decreasing obliquely from one side to the other side of the secondary spool in the axial direction, and the enlarged winding part including the secondary electric wire is wound with a winding diameter increasing obliquely from the other side to the one side of the secondary spool in the axial direction. Accordingly, the size of the ignition coil can be effectively reduced by using the coil body which is transversely arranged outside the plug hole.

The secondary coil has the maximum outer diameter portion disposed at the intermediate position where the plug connection portion is provided, and the inclined outer diameter portion disposed on the two sides of the maximum outer diameter portion in the axial direction. The maximum outer diameter portion and inclined outer diameter portion are formed by diagonally winding the wire. Thus, the secondary coil can be formed without forming a flange in a part of the outer periphery of the secondary spool for winding the secondary electric wire. This can reduce the dimensions of the secondary spool in the axial and radial directions, thereby leading to a reduction in size of the coil body of the ignition coil.

Furthermore, because the secondary coil is formed by diagonally winding the secondary electric wire, it can easily prevent a deformation of winding of the secondary wire.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

Figure 1:
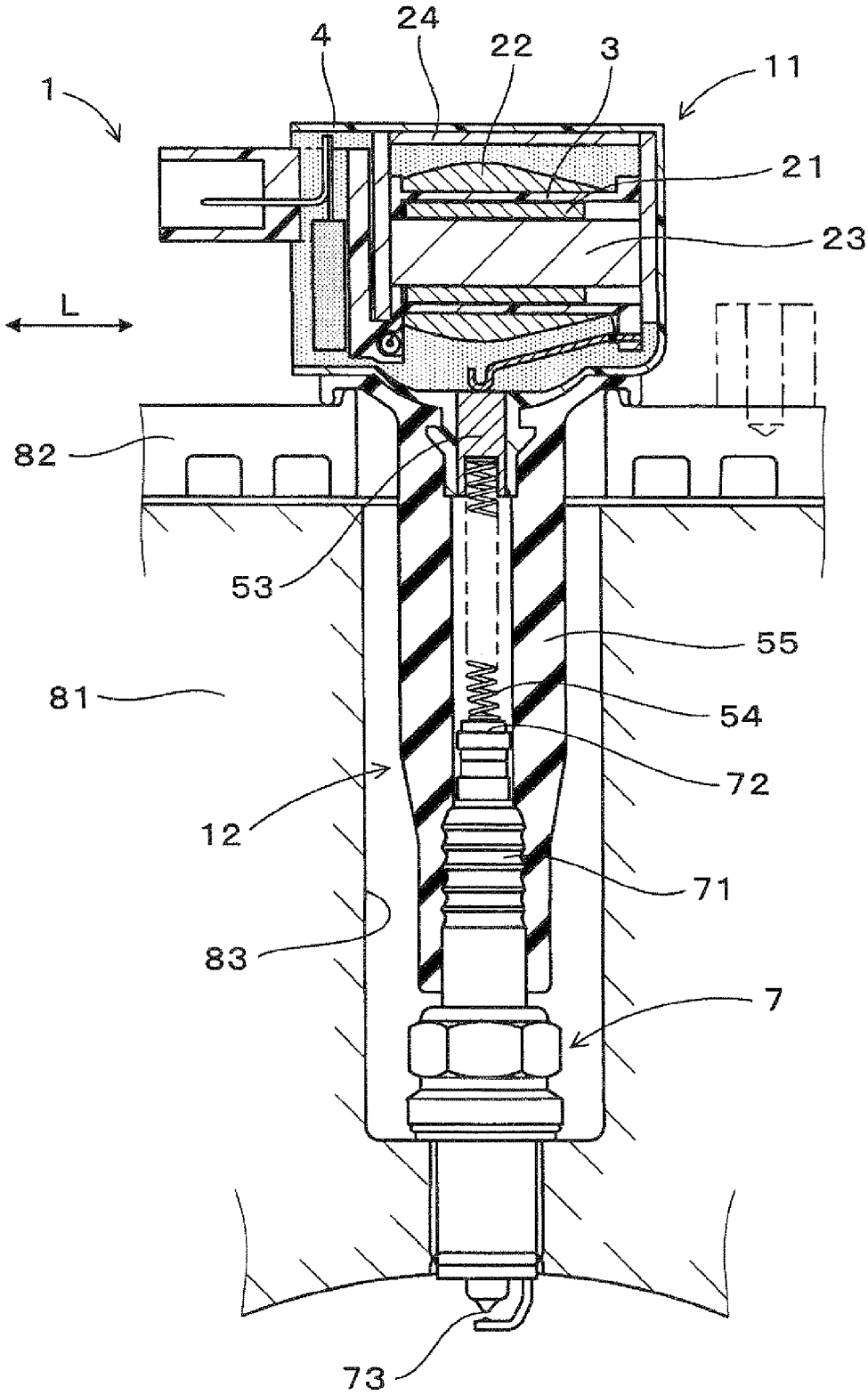
FIG. 1 is a schematic sectional view showing an entire structure of an ignition coil arranged in a plug hole according to an embodiment of the invention.

According to a preferred embodiment of the present invention, an ignition coil (1) includes a coil body (11) and a plug connection portion (12). The coil body (11) includes a center core (23) made of a soft magnetic material, a primary coil (21) and a secondary coil (22), which are located in a coil case (4). The plug connection portion (12) protrudes in a direction perpendicular to an axial direction (L) of the coil body (11) and adapted to bring a high-voltage side winding end of the secondary coil (22) into conduction with a spark plug (7). The coil body (11) can be transversely arranged outside a plug hole (83) of an engine, and the plug connection portion (12) can be inserted into and arranged in the plug hole (83). The primary coil (21) is arranged on an inner peripheral side of the secondary coil (22), and the center core (23) is arranged on an inner peripheral side of the primary coil (21), in the coil body (11). Furthermore, the plug connection portion (12) is provided to protrude substantially from an intermediate position in the axial direction of the coil body (11).

In the ignition coil, the secondary coil (22) has a maximum outer diameter portion (225) with a maximum winding diameter arranged in the intermediate position in the axial direction (L), and an inclined outer diameter portion (226) arranged on two sides of the maximum outer diameter portion (225) in the axial direction. The inclined outer diameter portion (226) has a winding diameter decreasing toward two ends in the axial direction (L) of the coil body (11). The secondary coil (22) includes a secondary electric wire with an insulating film, wound around an outer periphery of a secondary spool (3), and is provided in an obliquely wound state where reduced winding parts (223) and enlarged winding parts (224) are alternately superimposed on each other. In addition, the reduced winding part (223) including the secondary electric wire is wound with a winding diameter decreasing obliquely from one side to the other side of the secondary spool (3) in the axial direction, and the enlarged winding part (224) including the secondary electric wire is wound with a winding diameter increasing obliquely from the other side to the one side of the secondary spool (3) in the axial direction. Accordingly, the size of the ignition coil (1) can be effectively reduced by using the coil body (1) which is transversely arranged outside the plug hole (83).

Preferably, the ignition coil (1) includes an outer peripheral core (24) made of a soft magnetic material and arranged on an outer peripheral side of the secondary coil (22), and an intermediate core (25) made of a soft magnetic material and arranged between the outer peripheral core (24) and two ends of the center core (23) in the axial direction (L). In this case, the outer peripheral core (24) has a C-like sectional shape with a cutout portion (241) arranged on a side of the plug connection portion (12). Furthermore, the secondary spool (3) has on the side of the cutout portion (241), a low-voltage side terminal electrically connected to a low-voltage side winding end of the secondary coil (22), and a high-voltage side terminal electrically connected to a high-voltage side winding end of the secondary coil (22). Accordingly, the low-voltage side terminal and the high-voltage side terminal can be arranged using a space formed in the cutout portion (241) of the outer peripheral core (24).

Preferably, the plug connection portion (12) includes a mounting base (45) provided to protrude from an outer periphery of the coil case (4), and a rubber plug cap (55) disposed on the mounting base (45). Furthermore, the coil case (4) has a protruding outer peripheral portion (44) protruding from a part of the outer periphery thereof outward in a radial direction (R) of the coil body (11), and the mounting base (45) is provided to protrude from the protruding outer peripheral portion (44).

In this case, the protruding outer peripheral portion (44) positioned on the outer peripheral side of the maximum outer diameter portion (225) of the secondary coil (22) can be arranged in the opening of the plug hole (83) in the coil case (4). This can form the part of the secondary coil (22) positioned on the outer peripheral side of the inclined outer peripheral portion (226) and on the side opposed to the plug hole (83) in a small size in the radial direction.

Preferably, the primary coil (21) includes a primary electric wire wound in a cylindrical shape and fusion-bonded by a fusing agent, and is directly arranged on an outer peripheral side of the center core (23). In this case, a spool for the primary coil (21) can be omitted, thereby further reducing the size of the ignition coil (1).

The coil case (4) and the secondary spool (3) may be made of resin. Preferably, the maximum outer diameter portion (225) has a radial dimension that is larger than two or more times of a radial dimension at a winding start end (227) of the inclined outer diameter portion (226).

The secondary spool (3) may have a flange (303, 304) located only at its two ends in the axial direction (L). In this case, the flange (303, 304) protrudes outward by a protruding dimension in the radial direction (R) of the coil body (11), and the protruding dimension can be set smaller than a radial dimension (r1) of the maximum outer diameter portion (225).

More preferably, each enlarged winding part (224) has an inclined angle between the enlarged winding part (224) and the outer periphery of the secondary spool (3) on the one side, and the inclined angle of the enlarged winding part (224) is made gradually smaller as the enlarged winding part (224) is positioned on the other end side in the axial direction (L).

TYPICAL EXAMPLE OF EMBODIMENT

Now, a typical example of an ignition coil according to an embodiment of the invention will be described below with reference to the accompanying drawings.

As shown in FIG. 1, an ignition coil 1 of this embodiment includes a coil body 11 for accommodating a primary coil 21 and a secondary coil 22 stacked on the respective inner and outer peripheral sides in a resin coil case 4. The ignition coil 1 also includes a plug connection portion 12 extending in a direction perpendicular to an axial direction L of the coil body 11 and adapted to bring a high-voltage side winding end 221 of the secondary coil 22 into conduction with a spark plug 7. In the ignition coil 1, the plug connection portion 12 is arranged and inserted into a plug hole 83 provided in a cylinder head 81 and a cylinder head cover 82 of the engine, and the coil body 11 is transversely arranged near an opening of the plug hole 83 in the cylinder head cover 82.

Figure 2:
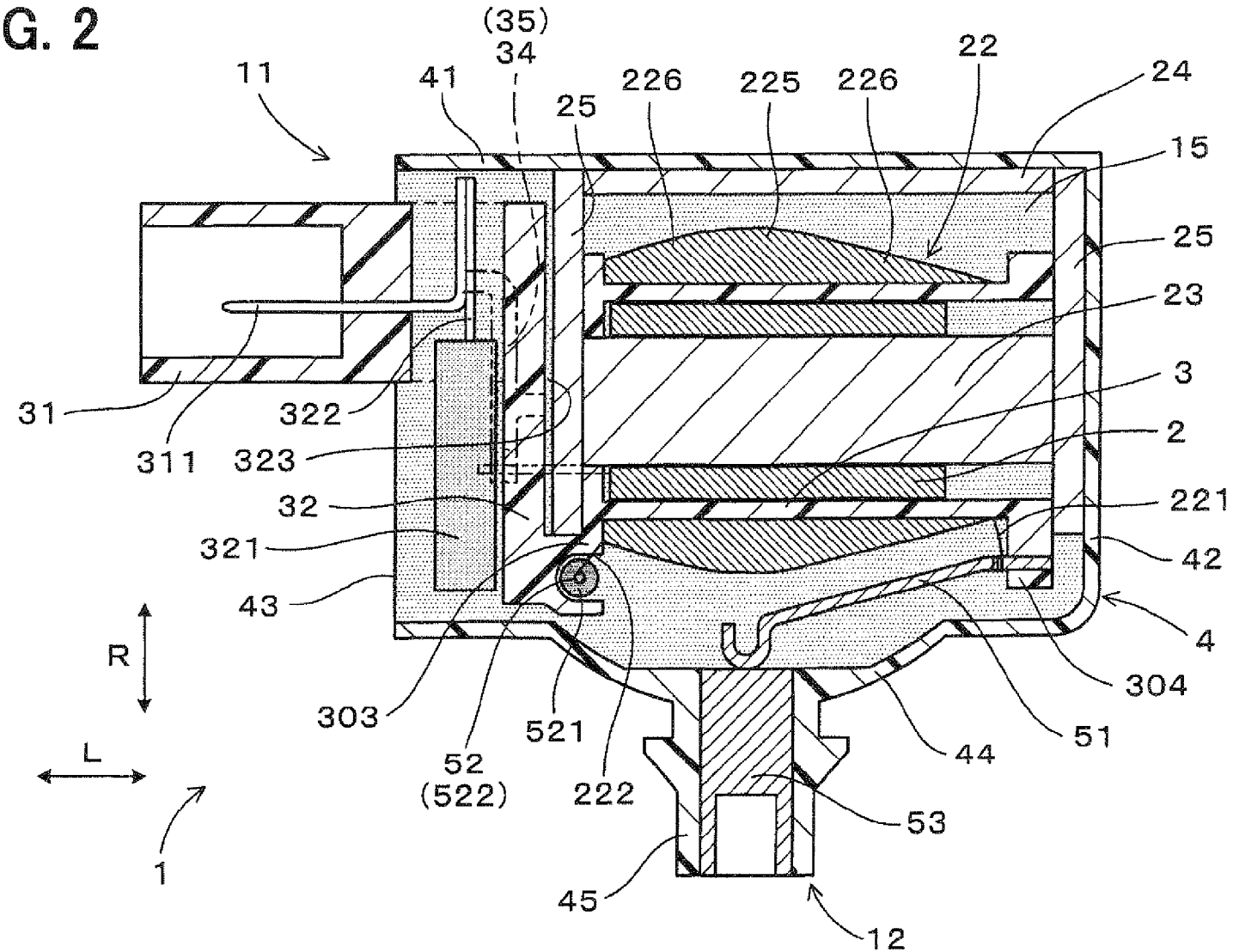
FIG. 2 is a schematic sectional view showing the ignition coil of the embodiment before being arranged in the plug hole.
Figure 3:
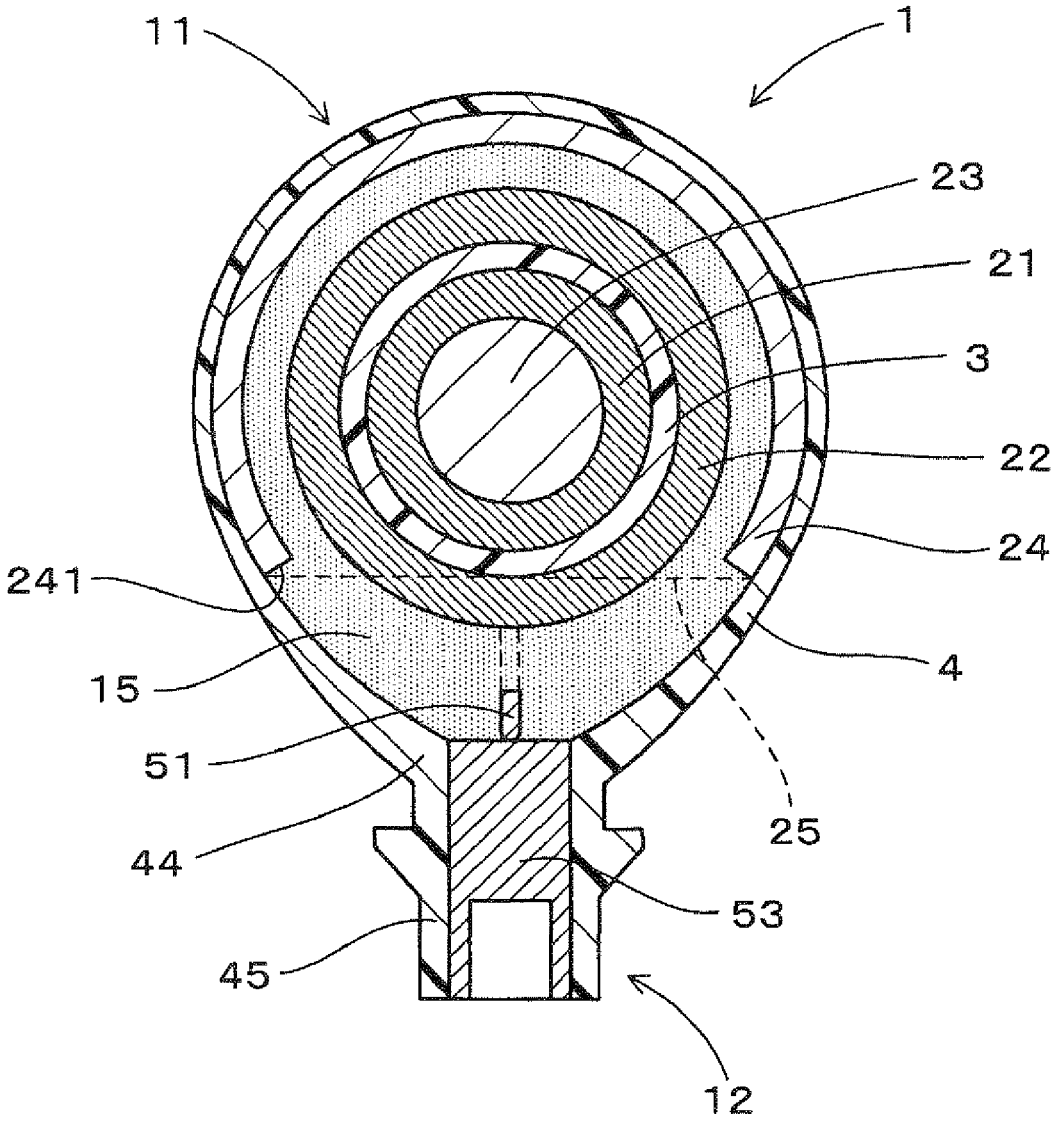
FIG. 3 is another schematic sectional view showing the ignition coil of the embodiment before being arranged in the plug hole.

As shown in FIGS. 2 and 3, the primary coil 21 is arranged on the inner peripheral side of the secondary coil 22. A center core 23 made of a soft magnetic material is arranged on the inner peripheral side of the primary coil 21. The plug connection portion 12 is provided to protrude from an intermediate position in the axial direction L of the coil body 11. In this example shown in FIG. 1, the plug connection portion 12 is located to protrude substantially from the center position of the coil case 4 in the axial direction L.

The secondary coil 22 has a maximum outer diameter portion 225 having the maximum winding diameter located in the intermediate position where the plug connection portion 12 is provided. The secondary coil 22 also includes inclined outer diameter portions 226 arranged on two ends of the maximum outer diameter portion 225 in the axial direction L and having the winding diameter decreasing toward the two ends in the axial direction L.

Figure 4:
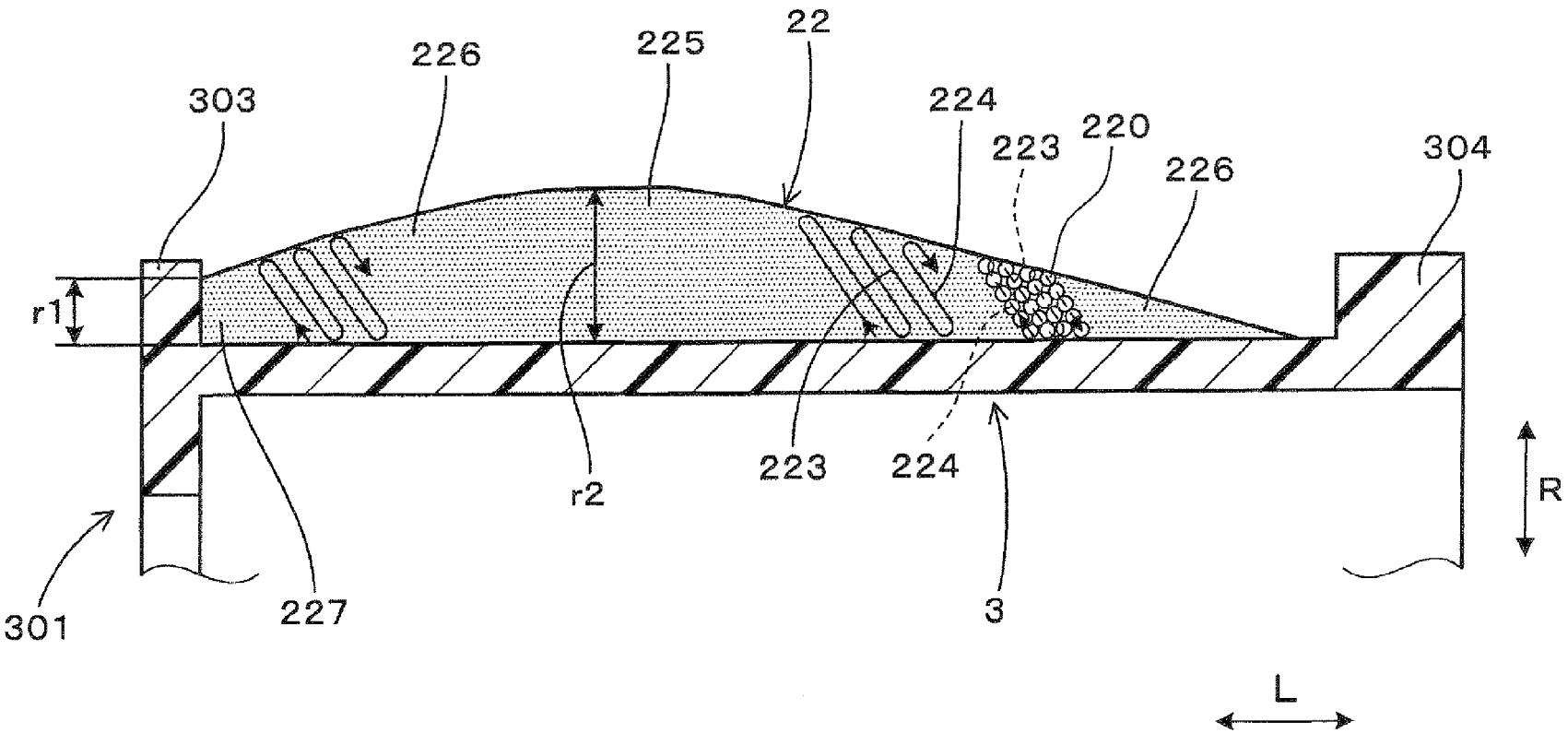
FIG. 4 is a schematic sectional view showing a state in which a secondary coil is formed on a secondary spool in the embodiment.

As shown in FIG. 4, the secondary coil 22 includes a secondary electric wire 220 with an insulating film, wound around the outer periphery of the resin secondary spool 3. The secondary coil 22 is formed in a diagonally wound state where a reduced winding part 223 and an enlarged winding part 224 are superimposed on each other. In the reduced winding part 223, the secondary wire 220 is wound with a winding diameter decreasing from one end side to the other end side of the secondary spool 3 in the axial direction L. In the enlarged winding part 224, the secondary wire 220 is wound with a winding diameter increasing from the other end side to the one end side of the secondary spool 3 in the axial direction L.

FIG. 1 shows an entire structure of the ignition coil 1 according to an example of an embodiment of the present invention. FIGS. 2 and 3 show the ignition coil 1 before assembly of a spring 54 and a plug cap 55 as described later, and before being arranged in the plug hole 83. FIG. 4 is a schematic diagram showing a state in which the secondary coil 22 is formed on the secondary spool 3.

The ignition coil 1 of this embodiment will be described below in detail with reference to FIGS. 1 to 7.

As shown in FIGS. 1 to 3, the plug connection portion 12 in the ignition coil 1 of this embodiment includes a mounting base 45 formed to protrude from the outer periphery of the coil case 4, a conducting terminal 53 provided in the mounting base 45, a rubber plug cap 55 mounted onto the mounting base 45, and the coil spring 54 arranged in the plug cap 55.

The spark plug 7 is screwed into a bottom portion of the plug hole 83 of the cylinder head 81, and the plug cap 55 of the ignition coil 1 is mounted to an insulator 71 of the spark plug 7, so that the lower end of the coil spring 54 is brought into conduction with a terminal 72 positioned at the tip of the insulator 71 of the spark plug 7. At this time, the high-voltage side winding end 221 of the secondary coil 22 is brought into conduction with the end of the spark plug 7 via a high voltage terminal 51, the conducting terminal 53, and the coil spring 54.

As shown in FIGS. 2 and 3, an outer peripheral core 24 made of a soft magnetic material is arranged on the outer peripheral side of the secondary coil 22 in the coil body 11 of the ignition coil 1 of this embodiment. Intermediate cores 25 made of a soft magnetic material are arranged between the outer peripheral core 24 and the two ends of the center core 23 in the axial direction L. The outer peripheral core 24 has a C-like sectional shape with a cutout portion 241 arranged on the side of the plug connection portion 12.

The center core 23 is formed to have a substantially circular sectional shape by laminating a plurality of plate-like electromagnetic steel plates (e.g., silicon steel plates or the like) in the radial direction R. As shown in FIG. 2. the radial direction R is a direction perpendicular to the axial direction L. The outer peripheral core 24 is constructed of a lamination of the electromagnetic steel plates (e.g., silicon steel plates or the like) in the radial direction R, each having a C-like sectional shape along the shape of the inner peripheral surface of the coil case 4. The outer peripheral core 24 has the cutout portion 241 formed over the entire length thereof in the axial direction L. That is, as shown in FIG. 3, the cutout portion 241 is an opening formed in the outer peripheral core 24. The cutout portion 241 is open in a direction facing the plug connection portion 12. The outer peripheral core 24 is arranged on the inner peripheral surface of the coil case 4.

The primary core 21 of this embodiment is constructed of a primary electric wire, which is a self-fusing wire, wound in a cylindrical shape without using the resin primary spool and fusion-bonded by a fusing agent of the self-fusing wire. The primary core 21 is directly arranged on the outer peripheral side of the center core 23. The primary electric wire is wound on a stick-like jig in a cylindrical shape, and then energized to be heated. Thus, the primary core is fusion-bonded by the fusing agent on the surface thereof to be molded in a cylindrical shape, so that the primary coil 21 can be formed by being removed from the jig.

As shown in FIG. 2, the secondary spool 3 with the secondary coil 22 of this embodiment wound thereon has flanges 303 and 304 located on both ends thereof in the axial direction L and protruding outward in the radial direction R. The secondary electric wire 220 is wound between the flanges 303 and 304. The secondary electric wire 220 has a diameter smaller than that of the primary electric wire, and the number of winding of the secondary wire 220 is larger than that of the primary electric wire.

A connector 31 is formed at one end 301 of the secondary spool 3 in the axial direction L to connect the ignition coil 1 to an external electronic control unit (ECU) or the like.

The connector 31 of this embodiment into which a plurality of conducting pins 311 are insert molded is formed integrally with a resin igniter arranging portion 32 for arranging an igniter 321 including a switching control circuit for energization and non-energization to the primary coil 21.

Figure 5:
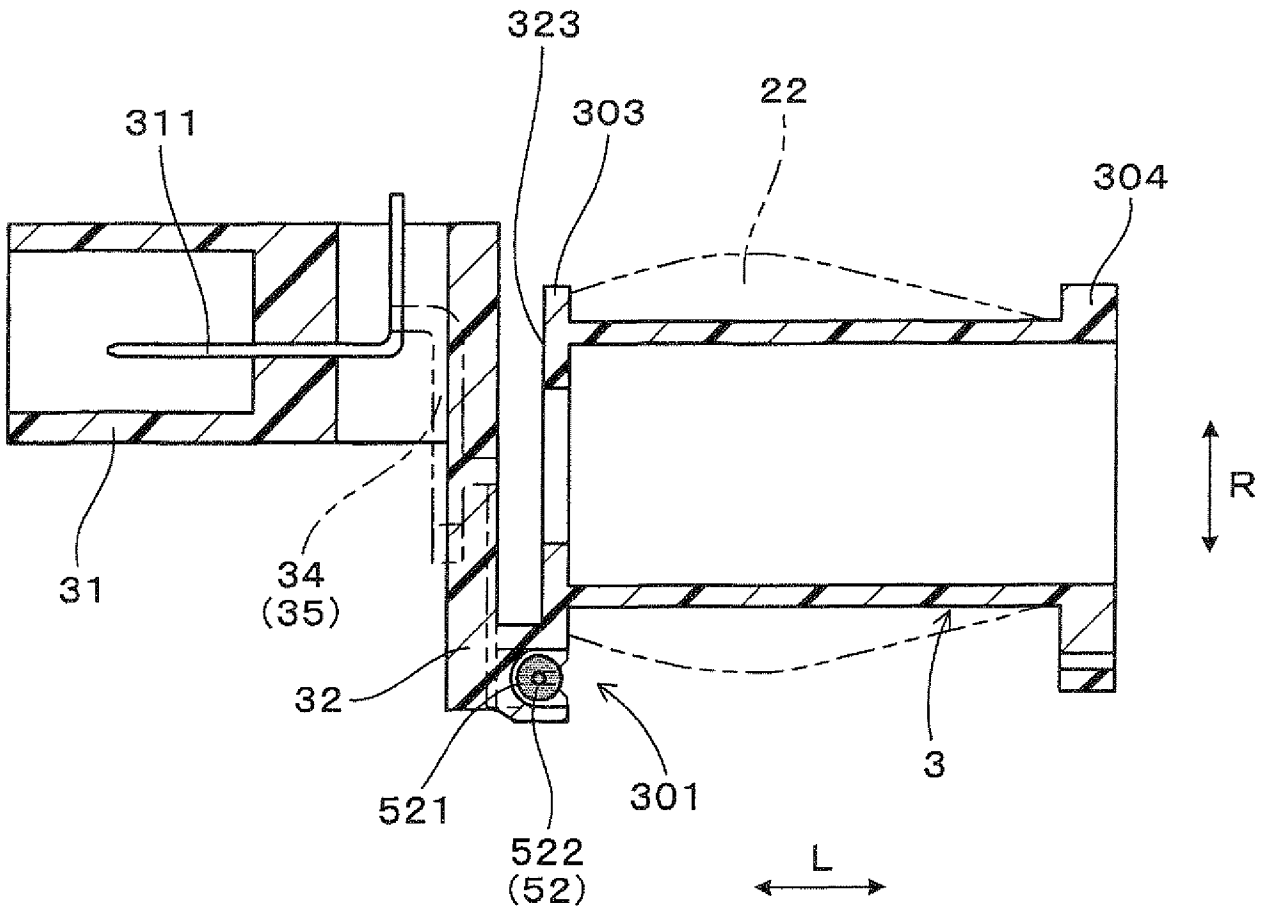
FIG. 5 is a schematic sectional view showing the secondary spool before being assembled to the ignition coil in the embodiment.

As shown in FIGS. 2 and 5, the igniter arrangement portion 32 of this embodiment is integrally formed with the one end 301 of the secondary spool 3 in the axial direction L, and the connector 31 is integrally formed with the igniter arrangement portion 32. A concave space 323 for positioning one intermediate core 25 therein is formed between the secondary spool 3 and the igniter arrangement portion 32. The connector 31 is formed to protrude from the igniter arrangement portion 32 with the conducting pins 311 arranged in the axial direction L.

FIG. 5 shows the secondary spool 3 before being assembled to the ignition coil 1.

As shown in FIG. 2, the coil case 4 has a bottom 42 on one end (e.g., right end in FIG. 2) of a cylindrical outer peripheral portion 41 in the axial direction L, and an opening 43 at the other end thereof. At the inner surface of the bottom 42 of the coil case 4, the other intermediate core 25 is arranged. The coil case 4 has a protruding outer peripheral portion 44 protruding from a part of the outer peripheral portion 41 outward the plug connection portion 12 in the radial direction R. The mounting base 45 is formed to protrude from the protruding outer peripheral portion 44, in the plug connection portion 12.

The connector 31 is arranged to protrude from the opening 43 of the coil case 4 in the axial direction L.

The secondary spool 3 has on the plug connection portion 12 side (i.e., on the cutout portion 241 side of the outer peripheral core 24), a low-voltage side terminal 52 which is electrically connected to a low-voltage side winding end 222 of the secondary coil 22, and the high-voltage side terminal 51 which is electrically connected to the high-voltage side winding end 221 of the secondary coil 22.

As shown in FIG. 4, the secondary coil 22 diagonally wound is formed by forming a winding start portion 227 near the flange 303 on one end of the secondary spool 3 in the axial direction L, superimposing the reduced winding part 223 and the enlarged winding part 224 on each other, and then continuing winding toward the other end of the secondary spool 3 in the axial direction L. The secondary coil 22 obliquely wound on the secondary spool 3 is formed such that an angle of inclination of winding of the reduced winding part 223 and the enlarged winding part 224 gradually becomes small toward the winding end side (i.e., the other end side of the secondary spool 3 in the axial direction L).

An shown in FIG. 4, a thickness r2 of winding of the secondary electric wire 220 at the maximum outer peripheral portion 225 can be two or more times as large as a thickness r1 of winding of the secondary electric wire 220 at the tip end of the inclined outer diameter portion 226 positioned on the winding start side (i.e., on one end side of the secondary spool 3 in the axial direction L). That is, the radial dimension (r2) of the maximum outer peripheral portion 225 can be set larger than two or more times of the radial dimension at the winding start end of the inclined outer diameter portion 226.

As shown in FIG. 2, the high-voltage side terminal 51 of this embodiment is formed to extend from the other flange 304 of the secondary spool 3 toward an intermediate position of the coil case 4. That is, the high-voltage side terminal 51 extends from the other flange 304 to the conducting terminal 53 that is located in the mounting base 45.

In the mounting base 45, the conducting terminal 53 is provided for bringing the high-voltage side terminal 51 into conduction with the coil spring 54.

Figure 7:
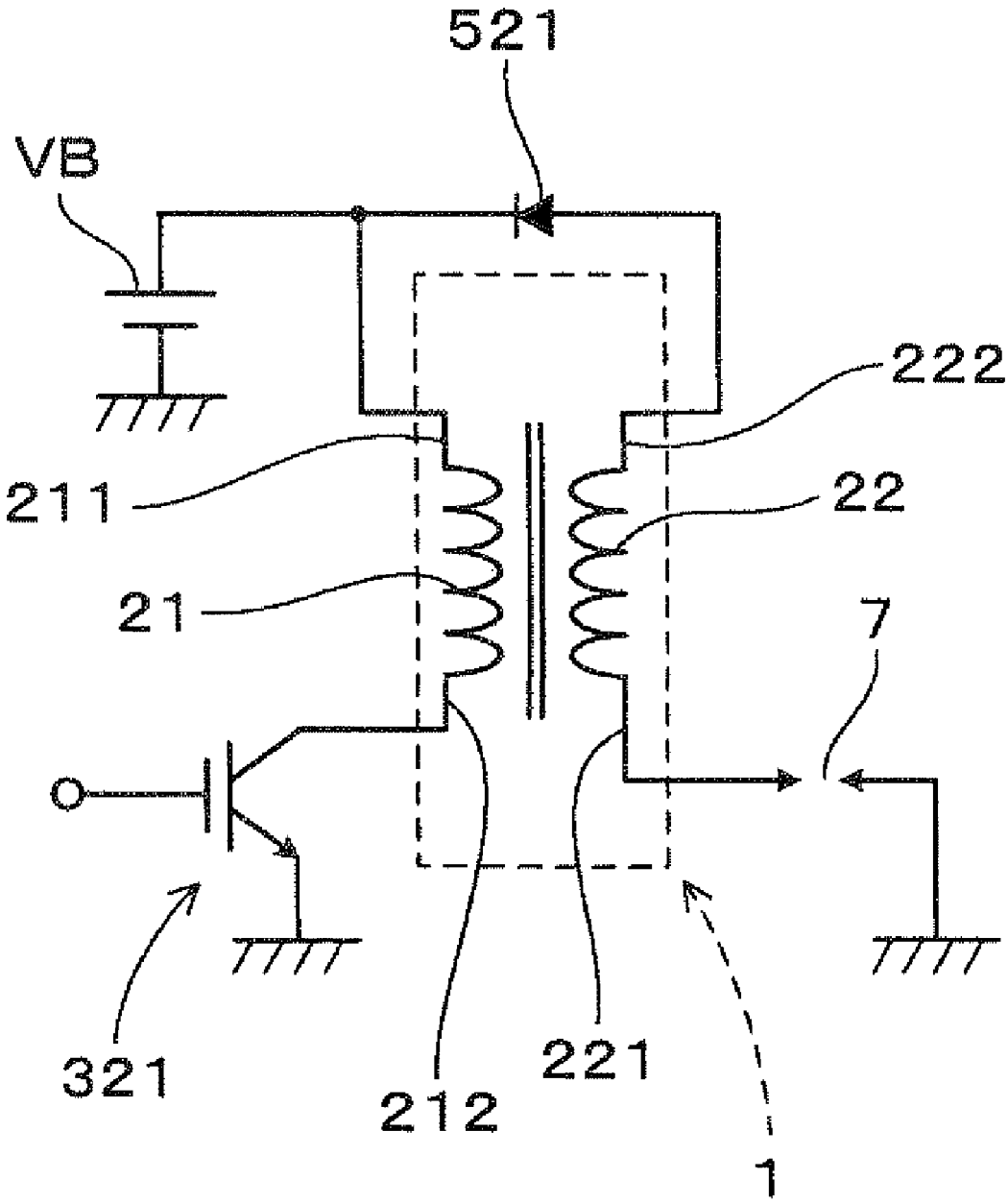
FIG. 7 is a schematic diagram showing a circuit configuration of the ignition coil in the embodiment.

FIG. 7 schematically shows a circuit configuration of the ignition coil 1 of this embodiment. A positive side winding end 211 of the primary coil 21 is connected to a battery power source VB, and a negative side winding end 212 of the primary coil 21 is connected to a switching element in the switching control circuit of the igniter 321. The low-voltage side winding end 222 of the secondary coil 22 is connected to an anode terminal of a diode 521, and a cathode terminal of the diode 521 is connected to the battery power source VB and the positive winding end 211 of the primary coil 21.

Figure 6:
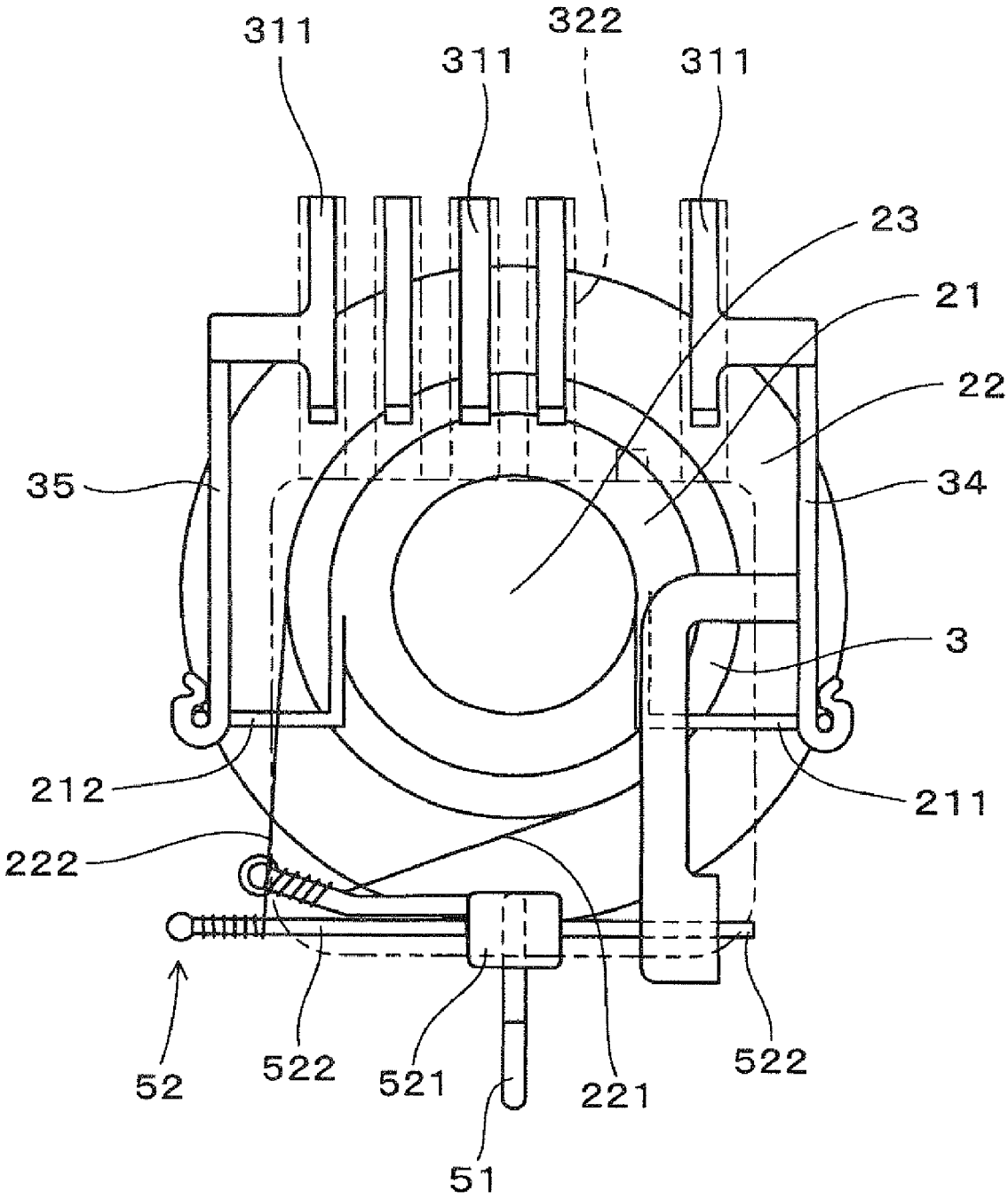
FIG. 6 is a schematic diagram showing a state in which terminals provided in electric connection portions of primary and secondary coils, conducting pins, and the like are formed in the embodiment.

As shown in FIGS. 6 and 7, the low-voltage side terminal 52 of this embodiment is formed by diverting a terminal 522 of the diode 521 such that an induced electromotive force caused in the secondary coil 22 is not applied to the spark plug 7 at start of energization to the primary coil 21. The igniter arrangement portion 32 is provided with a first conducting member 34 for attaching the diode 521. The diode 521 can be attached to the igniter arrangement portion 32 formed, and thus can be insert molded into the igniter arrangement portion 32.

One terminal 522 of the diode 521 is connected to the first conducting member 34, and the other terminal 522 of the diode 521 is connected to the low-voltage side winding end 222 of the secondary coil 22. The first conducting member 34 is connected to the positive side winding end 211 of the primary coil 21.

FIG. 6 shows the formed state of the terminals 51 and 52, the conducting pins 311 and 322, and the like which are provided in electrical connection parts of the primary coil 21 and the secondary coil 22.

In the igniter arrangement portion 32, a second conducting member 35 connected to the negative side winding end 212 of the primary coil 21 is provided on the side opposite to the side of the first conducting member 34.

The conducting pin 322 of the igniter 321 is connected to the conducting pin 311 of the connector 31 by welding or the like. Each of the first conducting member 34 and the second conducting member 35 is integrally formed with one of the conducting pins 311 of the connector 31.

As shown in FIGS. 2 and 3, a clearance of the ignition coil 1 enclosed by the coil case 4 is filled with a thermosetting resin (e.g., epoxy resin or the like) 15 for fixing and insulating of respective components which include the primary coil 21, the secondary coil 22, the center core 23, the outer peripheral core 24, the intermediate core 25, the igniter 321, and the like.

After assembly of the respective components of the ignition coil 1, the inside of the clearance of the ignition coil 1 is brought into a vacuum state, and then filled with the liquid thermosetting resin 15, which becomes thereafter hardened.

When a command is received from an ECU in the ignition coil 1 of this embodiment to energize the primary coil 21 by the switching control circuit of the igniter 321, a magnetic field is formed to pass through the center core 23, the intermediate core 25, and the outer peripheral core 24. Then, when the energization to the primary coil 21 is interrupted, a voltage is generated in the primary coil 21 by a self-induction effect, while a high induced electromotive force is generated in the secondary coil 22 by a mutual induction effect, so that a spark can be made between a pair of electrodes 73 in the spark plug 7 that is provided in the ignition coil 1 (see FIG. 1).

This example of the above embodiment achieves the reduction in size of the ignition coil 1 using the coil body 11 that is transversely arranged outside the plug hole 83.

The secondary coil 22 of this embodiment includes the maximum outer diameter portion 225 approximately at the intermediate position where the plug connection portion 12 is provided, and the inclined outer diameter portion 226 arranged on both sides of the maximum outer diameter portion 225 in the axial direction L. The maximum outer diameter portion 225 and the inclined outer diameter portion 226 are formed by the diagonal winding as described above. Here, the maximum outer diameter portion 225 includes the maximum outer diameter point and an area adjacent the maximum outer diameter point in the axial direction.

Thus, this embodiment can form the secondary coil 22 without forming a flange in a part for winding the secondary electric wire 220 on the outer periphery of the secondary spool 3. This can reduce the dimensions of the secondary spool 3 in the axial direction L and the radial direction R, thereby reducing the size of the coil body 11 of the ignition coil 1.

In the ignition coil 1 of this embodiment, the protruding outer peripheral portion 44 is located on the outer peripheral side of the maximum outer diameter portion 225 of the secondary coil 22 in the coil case 4. The outer peripheral portion 44 can be arranged in the opening 43 of the plug hole 83. Thus, a part of the coil case 4 located on the outer peripheral side of the inclined outer diameter portion 226 of the secondary coil 22, and located on the side opposite to the plug hole 83 can be formed in a small size in the radial direction R. This can further reduce the size of the coil body 11 in the ignition coil 1.

The secondary coil 22 is formed by diagonally winding the secondary electric wire 220, and thereby it can easily prevent a deformation of winding of the secondary wire 220.

Thus, the ignition coil 1 of this embodiment can effectively reduce the size of the coil body 11 that is transversely arranged outside the plug hole 83.

Although the present invention has been fully described in connection with the preferred embodiments with reference to the accompanying drawings, it is to be noted that various changes and modifications will become apparent to those skilled in the art. Such changes and modifications are to be understood as being within the scope of the present invention as defined by the appended claims.

What is claimed is:

1. An ignition coil comprising:

a coil body that includes a center core made of a soft magnetic material, a primary coil and a secondary coil, which are located in a coil case, the coil body being transversely arranged outside a plug hole of an engine; and a plug connection portion protruding in a direction perpendicular to an axial direction of the coil body and adapted to bring a high-voltage side winding end of the secondary coil into conduction with a spark plug, the plug connection portion being inserted into and arranged in the plug hole, wherein the primary coil is arranged on an inner peripheral side of the secondary coil, and the center core is arranged on an inner peripheral side of the primary coil, in the coil body, wherein the plug connection portion is provided to protrude substantially from an intermediate position in the axial direction of the coil body, wherein the secondary coil has a maximum outer diameter portion with a maximum winding diameter arranged in the intermediate position in the axial direction, and an inclined outer diameter portion arranged on two sides of the maximum outer diameter portion in the axial direction, the inclined outer diameter portion having a winding diameter decreasing toward two ends in the axial direction of the coil body, wherein the secondary coil includes a secondary electric wire with an insulating film, wound around an outer periphery of a secondary spool, and is provided in an obliquely wound state where reduced winding parts and enlarged winding parts are alternately superimposed on each other, and wherein the reduced winding part including the secondary electric wire is wound with a winding diameter decreasing obliquely from one side to the other side of the secondary spool in the axial direction, and the enlarged winding part including the secondary electric wire is wound with a winding diameter increasing obliquely from the other side to the one side of the secondary spool in the axial direction.

2. The ignition coil according to claim 1, further comprising:

an outer peripheral core made of a soft magnetic material and arranged on an outer peripheral side of the secondary coil; and an intermediate core made of a soft magnetic material and arranged between the outer peripheral core and two ends of the center core in the axial direction, wherein the outer peripheral core has a C-like sectional shape with a cutout portion arranged on a side of the plug connection portion, and wherein the secondary spool has on the side of the cutout portion, a low-voltage side terminal electrically connected to a low-voltage side winding end of the secondary coil, and a high-voltage side terminal electrically connected to a high-voltage side winding end of the secondary coil.

3. The ignition coil according to claim 1, wherein the plug connection portion includes a mounting base provided to protrude from an outer periphery of the coil case, and a rubber plug cap disposed on the mounting base, and wherein the coil case has a protruding outer peripheral portion protruding from a part of the outer periphery thereof outward in a radial direction of the coil body, and the mounting base is provided to protrude from the protruding outer peripheral portion.

4. The ignition coil according to claim 1, wherein the primary coil includes a primary electric wire wound in a cylindrical shape and fusion-bonded by a fusing agent, and is directly arranged on an outer peripheral side of the center core.

5. The ignition coil according to claim 1, wherein the coil case and the secondary spool are made of resin.

6. The ignition coil according to claim 1, wherein the maximum outer diameter portion has a radial dimension that is larger than two or more times of a radial dimension at a winding start end of the inclined outer diameter portion.

7. The ignition coil according to claim 1, wherein the secondary spool has a flange located only at its two ends in the axial direction, and wherein the flange protrudes outward by a protruding dimension in a radial direction of the coil body, the protruding dimension being smaller than a radial dimension of the maximum outer diameter portion.

8. The ignition coil according to claim 1, wherein each enlarged winding part has an inclined angle between the enlarged winding part and the outer periphery of the secondary spool on the one side, and wherein the inclined angle of the enlarged winding part is made gradually smaller as the enlarged winding part is positioned on the other end side in the axial direction.

* * * * *